US009970170B2

(12) United States Patent
Terata et al.

(10) Patent No.: US 9,970,170 B2
(45) **Date of Patent: *May 15, 2018**

(54) SLUICE GATE

(71) Applicants: Hiroshi Terata, Yokohama-shi, Kanagawa (JP); Hiroko Terata, Yokohama-shi, Kanagawa (JP)

(72) Inventors: Hiroshi Terata, Yokohama (JP); Hiroko Terata, Yokohama (JP); Akira Ishido, Tokyo (JP); Shoko Kukita, Tokyo (JP); Keiichi Terata, Yokohama (JP); Yoko Terata, Yokohama (JP)

(73) Assignees: HIROSHI TERATA, Yokohama, Kanagawa (JP); HIROKO TERATA, Yokohama, Kangawa (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/630,528

(22) Filed: Jun. 22, 2017

(65) Prior Publication Data

US 2017/0284047 A1 Oct. 5, 2017

Related U.S. Application Data

(63) Continuation of application No. 14/423,008, filed as application No. PCT/JP2012/072416 on Sep. 4, 2012, now Pat. No. 9,783,946.

(51) Int. Cl.

| | |
|---|---|
| ***E02B 7/38*** | (2006.01) |
| ***E02B 8/04*** | (2006.01) |
| *E02B 3/10* | (2006.01) |

(52) U.S. Cl.

CPC ..... *E02B 8/04* (2013.01); *E02B 7/38* (2013.01); *E02B 3/10* (2013.01)

(58) Field of Classification Search

CPC ..... E02B 3/10; E02B 7/20; E02B 7/38; E02B 8/04

(Continued)

(56) References Cited

U.S. PATENT DOCUMENTS 3,935,711 A 2/1976 Sawai et al.

FOREIGN PATENT DOCUMENTS

| | | |
|---|---|---|
| JP | 49-28641 | 6/1972 |
| JP | 50-16334 | 2/1975 |

(Continued)

OTHER PUBLICATIONS

Communication dated Feb. 26, 2016, from the State Intellectual Property Office of People's Republic of China in counterpart Application No. 201280075626.8.

(Continued)

*Primary Examiner* — Sunil Singh

(74) *Attorney, Agent, or Firm* — Sughrue Mion, PLLC; Richard C. Turner

(57) ABSTRACT

A laterally sliding type opening/closing gate of a torsion structure of reasonable cost is implemented. The gate includes: the torsion structure having a closed cross-section consisting of a thin wall installed such that it may cross a sluice and be composed such that its cross-section may make an in-plane rotation around a restriction point on the cross-section and that a torsion moment generated by an applied load and reaction force on the restriction point is transmitted to its terminal due to its torsion rigidity; and a rail that is installed such that it may cross the sluice; and a plurality of axle type supports that has a function of a restriction point and moves along the rail.

10 Claims, 16 Drawing Sheets

(58) Field of Classification Search
USPC ..... 405/87, 92, 94, 103; 104/245
See application file for complete search history.

(56) References Cited

FOREIGN PATENT DOCUMENTS

| | | | |
|---|---|---|---|
| JP | 53-141055 | | 4/1977 |
| JP | 58-181979 | A | 10/1983 |
| JP | 5758583 | A | 6/1998 |
| JP | 2003-301442 | A | 10/2003 |
| JP | 2004-3211 | A | 1/2004 |
| JP | 2006-002552 | A | 1/2006 |
| JP | 2008-150829 | A | 7/2008 |

OTHER PUBLICATIONS

Machine Translation of JP 2008150829.
Terata et al., "Relating to Increase in Their Sizes and Operating Head," Studies on Hydraulic Gates, Mar. 1996, pp. 1-158, (298 pages total).
Terata, Hiroshi, "Structural Analysis of Torsion Type Gates," Journal of Japan Society of Dam Engineers, 1997, vol. 7, No. 1, pp. 1-19 (39 pages total).
Translation of JP 53-141055, 6 pages, Nov. 1978.

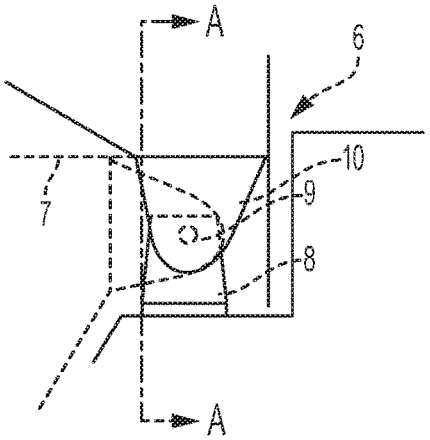
FIG. 1A
PRIOR ART
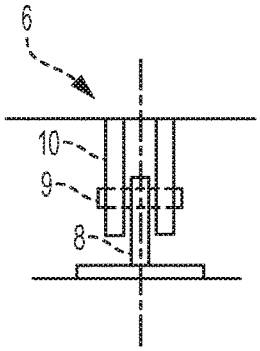
FIG. 1B
PRIOR ART
FIG. 2A
PRIOR ART
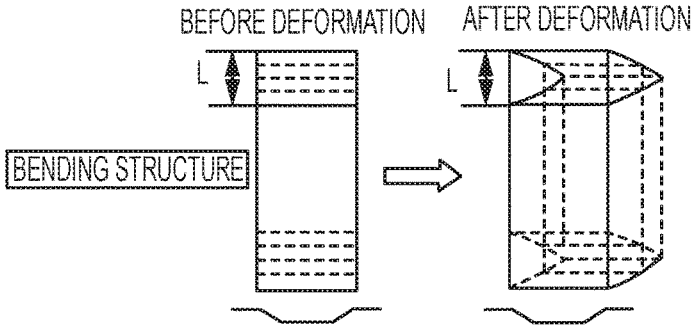
FIG. 2B
PRIOR ART
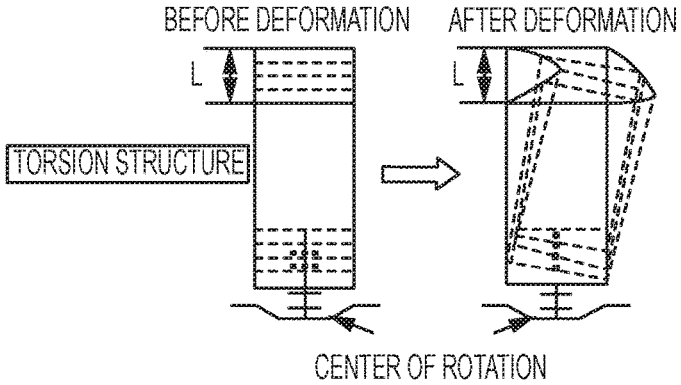

FIG. 3A
PRIOR ART
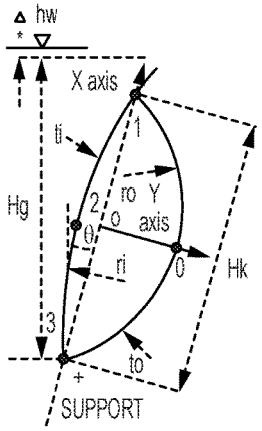
FIG. 3B
PRIOR ART
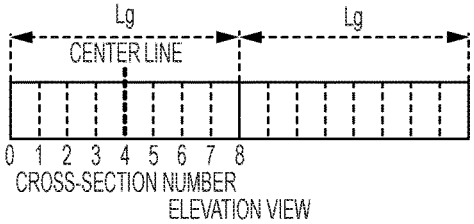
| SPECIFICATIONS OF FISH BELLY TYPE EXAMPLE | | | | | | | | | | | | |
|---|---|---|---|---|---|---|---|---|---|---|---|---|
| ITEMS | DOOR HEIGHT | DOOR WIDTH | CROSS-SECTION | | | | | OVER FLOW DEPTH | SUPPORT | | | ANGLE OF GRADIENT |
| | | | | | | | | | LOCATION | | NUMBER | |
| SYMBOL | Hg | Lg | Hk | ro | ri | to | ti | Δ hw | Lpy | Lpx | n | θ |
| VALUE | 6400 | 25000 | 6000 | 3480 | 9000 | 20 | 20 | 300 | 391 | 3206 | 9 | 15 |
| UNIT | mm | | | | | | | | | | | |
FIG. 3C
PRIOR ART
FIG. 4
PRIOR ART
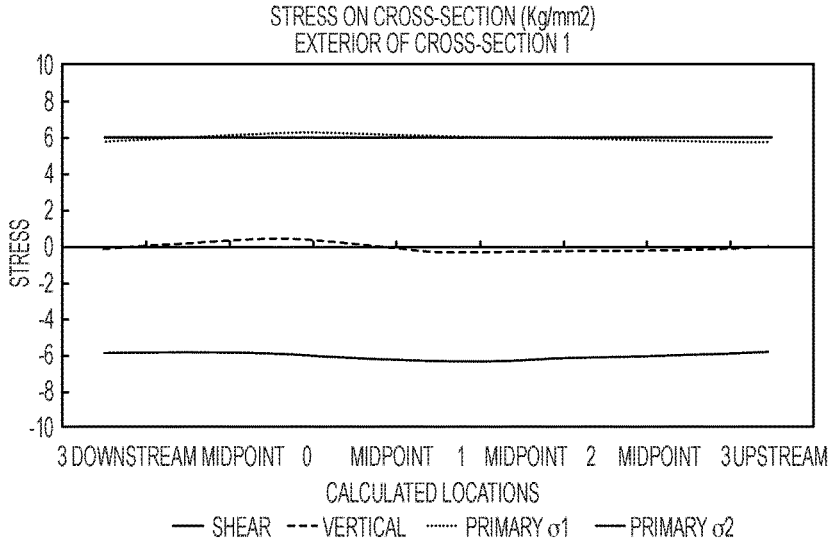

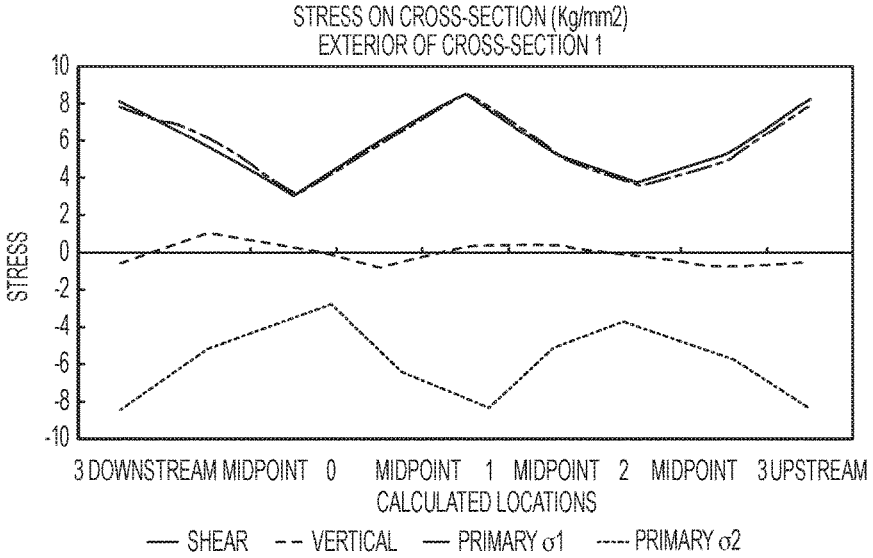
FIG. 5
PRIOR ART
FIG. 6A
PRIOR ART
| SPECIFICATIONS IN BASIC CASE | | | | | | | | | | |
|---|---|---|---|---|---|---|---|---|---|---|
| ITEM | FORM | | WALL THICKNESS | | | | DOOR WIDTH | SUPPORT | | |
| | | | | | | | | LOCATION | | NUMBER |
| SYMBOL | Lf | Lw | tf1 | tw1 | tf2 | tw2 | Lg | Lpy | Δpx | n |
| VALUE | 5000 | 13750 | 34 | 34 | 34 | 34 | 100000 | 0 | 2000 | 9 |
| UNIT | mm | | | | | | | | | |
FIG. 6B
PRIOR ART
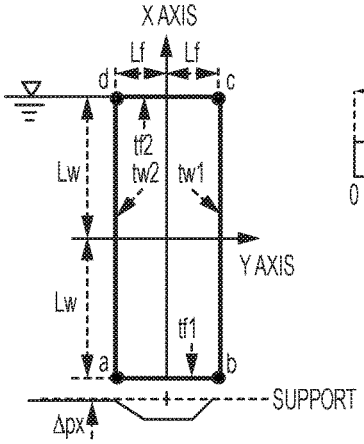
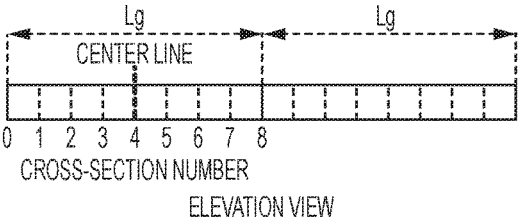
FIG. 6C
PRIOR ART FIG. 9A
PRIOR ART
| SPECIFICATIONS OF RECTANGLE TYPE EXAMPLE | | | | | | | | | | | | |
|---|---|---|---|---|---|---|---|---|---|---|---|---|
| ITEM | FORM | | WALL THICKNESS | | | | DOOR WIDTH | SUPPORT | | | DESIGN WATER DEPTH | |
| | | | | | | | | LOCATION | | NUMBER | | |
| SYMBOL | Lf | Lw | tf1 | tw1 | tf2 | tw2 | Lg | Lpy | Δpx | n | Δh1 | Δh2 |
| VALUE | 5000 | 13750 | ELEVATION VIEW (PER SECTION) | | | | 100000 | 0 | 2000 | 11 | 4.5 | 0.2 |
| UNIT | mm | | | | | | | | | | m | |
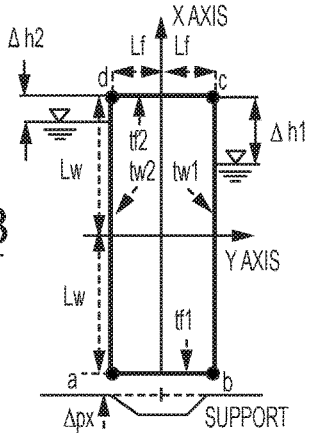
FIG. 9B
PRIOR ART
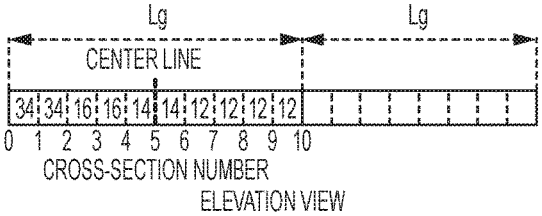
FIG. 9C
PRIOR ART
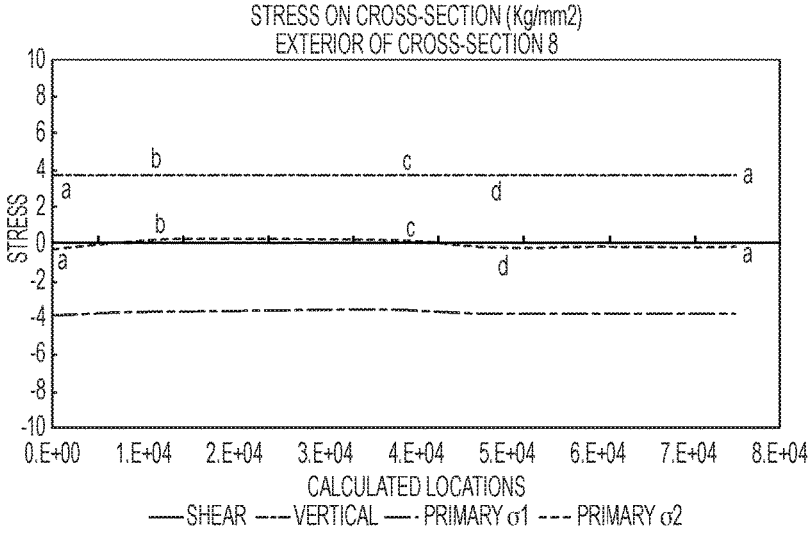
FIG. 10
PRIOR ART FIG. 13A
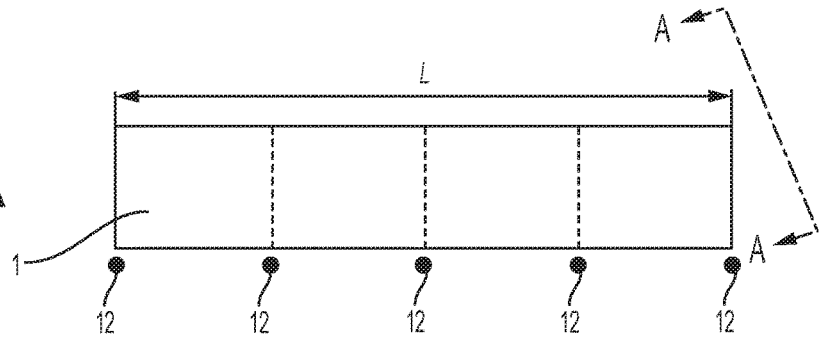
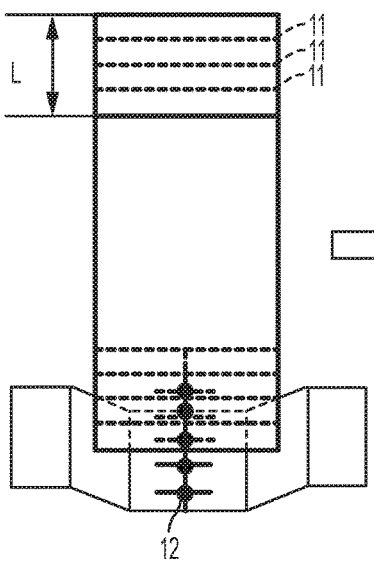
FIG. 13B
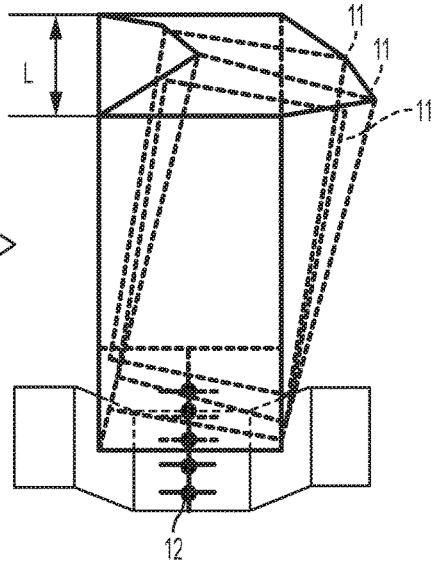
FIG. 13C FIG. 14A
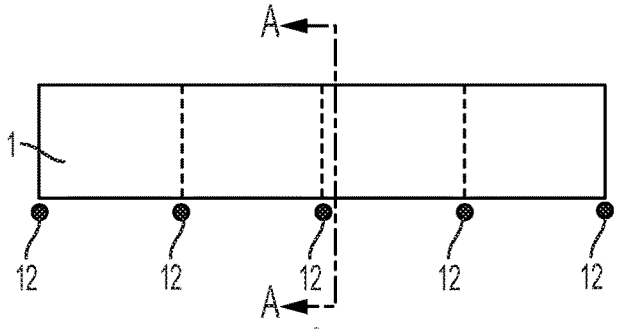
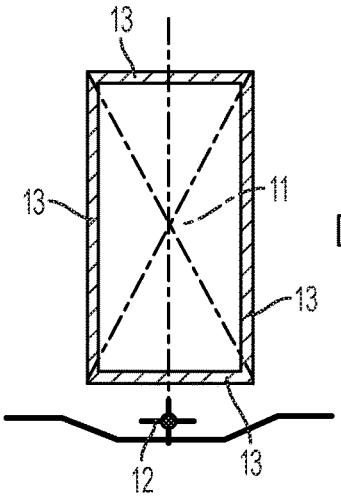
FIG. 14B
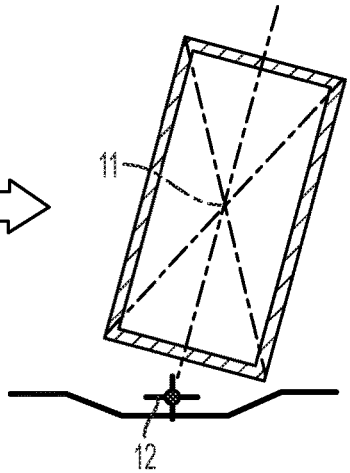
FIG. 14C
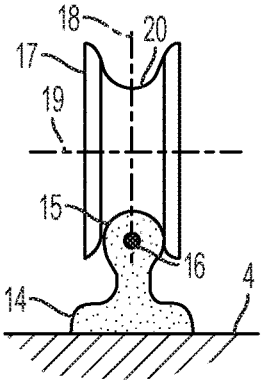
FIG. 15A
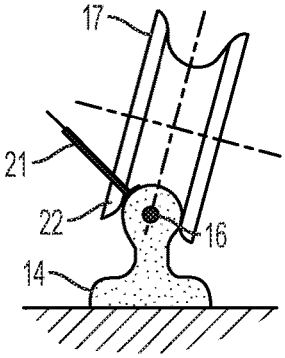
FIG. 15B

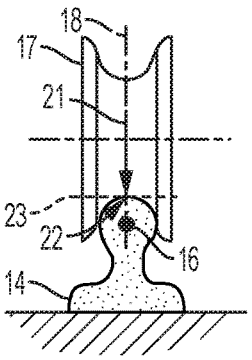
FIG. 16A
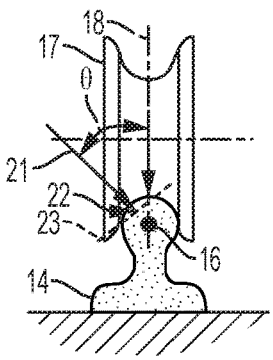
FIG. 16B
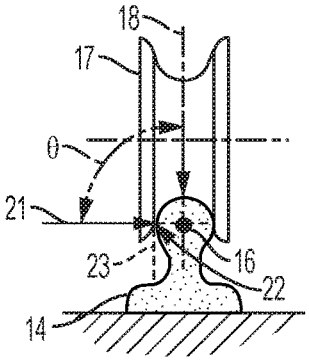
FIG. 16C
| θ DEGREES | 90 - θ DEGREES | FRICTION FORCE (TF) | OFF-RUNNING PREVENTION FORCE (TF) |
|---|---|---|---|
| 0 | 90 | 0 | 1000 |
| 45 | 45 | 707 | 707 |
| 90 | 0 | 1000 | 0 |
FIG. 17
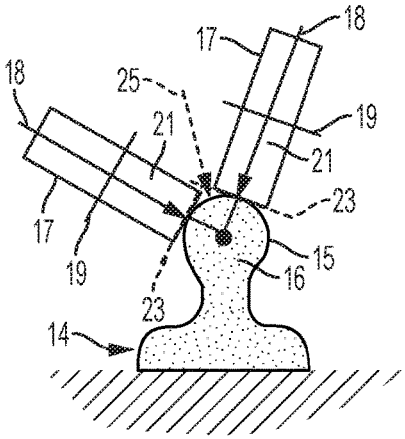
FIG. 18A
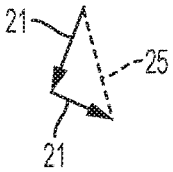
FIG. 18B

| DIMENSIONS OF RECTANGULAR TYPE CROSS-SECTION | | |
|---|---|---|
| SYMBOL | VALUE | UNIT |
| Lf | 5000 | mm |
| Lw | 13750 | |
| tf | 34 | |
| tw | 34 | |

CALCULATION RESULTS OF ZERO WARP WALL THICKNESS
(LENS TYPE CROSS-SECTION)

| NO | α° | α | RATIO η | t mm |
|---|---|---|---|---|
| 0 | 0 | 0 | 1.000 | 20.0 |
| 1 | 3 | 0.052 | 0.991 | 19.8 |
| 2 | 6 | 0.105 | 0.966 | 19.3 |
| 3 | 9 | 0.157 | 0.926 | 18.5 |
| 4 | 12 | 0.209 | 0.876 | 17.5 |
| 5 | 15 | 0.262 | 0.819 | 16.4 |
| 6 | 18 | 0.314 | 0.760 | 15.2 |
| 7 | 21 | 0.367 | 0.700 | 14.0 |
| 8 | 24 | 0.419 | 0.641 | 12.8 |
| 9 | 27 | 0.471 | 0.587 | 11.7 |
| 10 | 30 | 0.524 | 0.536 | 10.7 |

SLUICE GATE

CROSS REFERENCE TO RELATED APPLICATIONS

This application is a continuation of U.S. application Ser. No. 14/423,008, filed Apr. 6, 2015, which is a National Stage Entry of PCT/JP2012/072416, filed Sep. 4, 2012. The entire disclosures of the prior applications are considered part of the disclosure of the accompanying continuation application, and are hereby incorporated by reference.

TECHNICAL FIELD

The present invention relates to a sluice gate installed in a sluice for water flow or ships. The gate accommodates high tide water, tsunami, high water (reverse flow from a main river to a tributary stream), ocean waves, floodwood flow etc. and includes a land lock gate.

BACKGROUND ART

A large scale gate provided against high tide water, tsunami etc. is well known.

The gate of Patent Document 1 is a flap gate, which includes a gate leaf (torsion structure) that has a thin wall closed cross-section, and axle type supports supporting the gate leaf. The gate leaf is supported by a foundation ground via the axle type supports and rotates around the axles.

FIG. 1A and FIG. 1B show an example of an axle type support for a flap gate, where FIG. 1A shows its side elevation view and FIG. 1B shows a cross-section cut along line A-A of FIG. 1A.

Reference numeral 6 denotes a gate leaf (solid line, in a closed position), 7 denotes the gate leaf (dotted line, in an open position), 8 denotes a bottom support, 9 denotes a rotation axle, and 10 denotes a bracket.

The gate leaves 6 and 7 are fixed by welding etc. to the bracket 10 that is connected to the rotation axle 9. The bottom support 8 is sustained by a foundation ground.

When the gate is not in use, the gate leaf (in its open position) 7 is stored horizontally underwater as the dotted line shows. When in use, the gate leaf (in its open position) 7 rotates around the rotation axle 9, rises up, and moves to the position of the gate leaf (in its closed position) 6 of the solid line.

FIG. 2A and FIG. 2B explain a difference in characteristics of deformation between torsion and bending type structures. FIG. 2A shows the bending type structure and FIG. 2B shows the torsion structure, where L denotes span length.

A characteristic in the deformation of the bending type structure is the parallel displacement of its cross-section while that of the torsion structure is the in-plane rotation of its cross-section. The rotation center of the cross-section is the axle type support that restricts the displacement of the cross-section. The torsion structure is distinguished from the bending type structure by whether or not there is a restriction point on the cross-section.

Structural characteristics of both of the structural types are remarkably different when their cross-section is a thin wall closed cross-section. In short, the torsion structure is characterized by (1) the thin wall closed cross-section and (2) the cross-sectional restriction.

The torsion structure resists a load by square of its closed cross-sectional area while the bending type structure and the axial type structure resist by the cross-sectional secondary moment and axial rigidity of their members, respectively.

A load applied to the torsion structure is transmitted to a sectional restriction point, and a torsion moment composed by the load and the reaction force at the restriction point is transmitted to the support span terminal of the structure due to a sectional torsion rigidity while the loads applied to the bending and axial type structures are directly transmitted to their support span terminals due to a sectional shearing rigidity and an axial rigidity, respectively The bending type and axial type structures are 3-dimensional structures whereas the torsion structure may be classified as 2.5-dimensional structure.

The torsion structure has various advantages due to the structural differences described above, and these advantages become more remarkable as the structure support span gets longer. In the case of a 400 m span class super large gate, for instance, its steel weight will be ½ to ⅓ or less of other structural types. The lower gate weight results in lower construction costs.

PRIOR ART DOCUMENTS

Patent Documents

Patent Document 1: JP S50-16334A

Non-Patent Documents

Non-Patent Document 1: Hiroshi Terata, Structural analysis of torsion gates, Journal of JSDE Vol. 7 No. 1 1997

Non-Patent Document 2: Studies on hydraulic gates relating to increase in size and operating head, Dissertation, 1996 (submitted to Toyo University)

DISCLOSURE OF THE INVENTION

Problems to be Solved by the Invention

Although the torsion structure has an overwhelming advantage in cost, its application to a gate has been limited to a flap gate that is fixed on the foundation ground via axle type supports. This invention enables application of the torsion structure to, for instance, a tidal gate that moves laterally. The application is also applicable to a super large tidal gate having a structure support span between 200 to 600 m and more.

This invention shows resolutions to the following problems, contributing to implementation of a tidal gate of the torsion structure.

Problem 1: Lateral Movement of a Torsion Tidal Gate

Problem 2: Uneven Settlement of a Rail Foundation

Problem 3: Alleviation of Bending Torsion

Problem 1: Lateral Movement of a Torsion Tidal Gate

The invention implements the following gate functions: (1.1) Free twisting deformation, (1.2) Water pressure support while the gate is completely closed and (1.3) Water pressure support during gate movement. Following are explanations of each function.

(1.1) Free Twisting Deformation

A twisting deformation occurs in the torsion structure due to an applied load like water pressure, its own weight etc. As an additional bending deformation will occur in the structure if the center line of twisting in the structure is not straight, linearity of the line should be maintained so that a free twisting deformation without any additional restriction is possible.

(1.2) Water Pressure Support While the Gate is Completely Closed

When the gate is completely closed, maximum water pressure works on it, resulting in a twisting deformation of the torsion structure. In this condition, the working water pressure is surely transmitted from the gate rollers to the rail supporting the rollers.

(1.3) Water Pressure Support During Gate Movement

The gate moves laterally while it is subjected to water pressure that corresponds to a gate operation condition. The lateral movement is made without the rollers running off the rail.

Problem 2: Uneven Settlement of a Rail Foundation

While a rail is installed for lateral movement of a torsion tidal gate, the rail foundation may be deformed due to uneven settlement of the foundation ground after construction of the gate has started. Lateral movement of the gate is made possible even if any uneven settlement occurs in the rail foundation.

Problem 3: Alleviation of Bending Torsion

Twisting of a structure includes simple torsion and bending torsion. Simple torsion generates the simple torsion moment, thereby generating the shearing stress of the simple torsion on a cross-section of the structure while bending torsion generates the bending -torsion moment, resulting in adding the shearing stress of the bending torsion to the shearing stress of the simple torsion. As the shearing stress of the simple torsion distributes uniformly over the cross-section whereas the shearing stress of the bending torsion distributes nonuniformly like big waveforms over the cross-section, resulting in increase in the maximum stress of their sum.

The sectional stress of the torsion sluice gate increases substantially due to existence of the bending torsion. FIG. 3A through FIG. 11 are calculation examples. FIG. 4 and FIG. 5 show the simple torsion and the bending torsion of the gate leaf of FIGS. 3A through 3C, respectively. FIG. 7 and FIG. 8 show the simple torsion and the bending torsion of the gate leaf of FIGS. 6A through 6C, respectively. FIG. 10 and FIG. 11 show the simple torsion and the bending torsion of the gate leaf of FIGS. 9A through 9C, respectively.

As the bending-torsion moment does not contribute much to transmission of the torsion moment since its magnitude is small, alleviation of the bending torsion leads to cost reduction of the torsion structure.

Means of Solving the Problems

A sluice gate, which is equipped with a gate leaf of the torsion structure, a rail, and a plurality of axle type supports that works as a restriction point and moves along the rail, is proposed to implement a laterally sliding type opening/closing gate of the torsion structure at a reasonable cost. The axle type support includes a roller, cross-sectional form of the head region of the rail is a convex circular arc, and cross-sectional form of the tread surface of the roller is a concave circular arc whose radius corresponds to the radius of the convex circular arc of the head region of the rail. The roller and the rail work as an axle type support due to their good fit.

Alternatively, a plurality of rollers arranged so as to sandwich the head region of the rail may be provided.

BRIEF DESCRIPTION OF DRAWINGS

FIG. 1A and FIG. 1B illustrate an example of an axle type support for a flap gate;

FIG. 2A and FIG. 2B illustrate an explanatory drawing of difference in characteristics of deformation between torsion and bending type structures;

FIG. 3A through FIG. 3C illustrate an example of a gate leaf;

FIG. 4 illustrates the simple torsion in the example of FIG. 3A through FIG. 3C;

FIG. 5 illustrates the bending torsion in the example of FIG. 3A through FIG. 3C;

FIGS. 6A through 6C illustrate another example of a gate leaf;

FIGS. 9A through 9C illustrate another example of a gate leaf;

FIG. 10 illustrates the simple torsion in the example of FIG. 9A through FIG. 9C;

FIG. 13A through FIG. 13C are explanatory drawings of the torsion structure;

FIG. 14A through FIG. 14C show details of a thin wall closed cross-section and a sectional restriction point of FIG. 13A through FIG. 13C;

FIG. 15A and FIG. 15B are explanatory drawings of an axle type support of Embodiment 1;

FIG. 16A through FIG. 16C are explanatory drawings of the axle type support of Embodiment 1;

FIG. 17 is an explanatory drawing of the axle type support of Embodiment 1;

FIG. 18A and FIG. 18B are explanatory drawings of an axle type support of Embodiment 2;

EMBODIMENTS OF THE INVENTION

Embodiment 1

Figure 7:
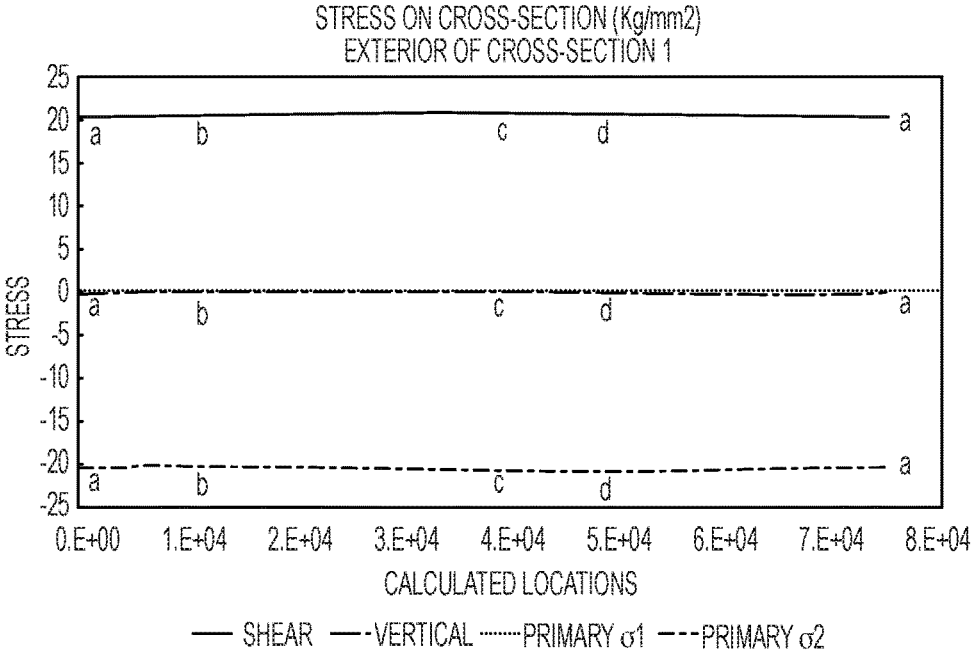
FIG. 7 PRIOR ART
FIG. 7 illustrates the simple torsion in the example of FIG. 6A through FIG. 6C.
Figure 8:
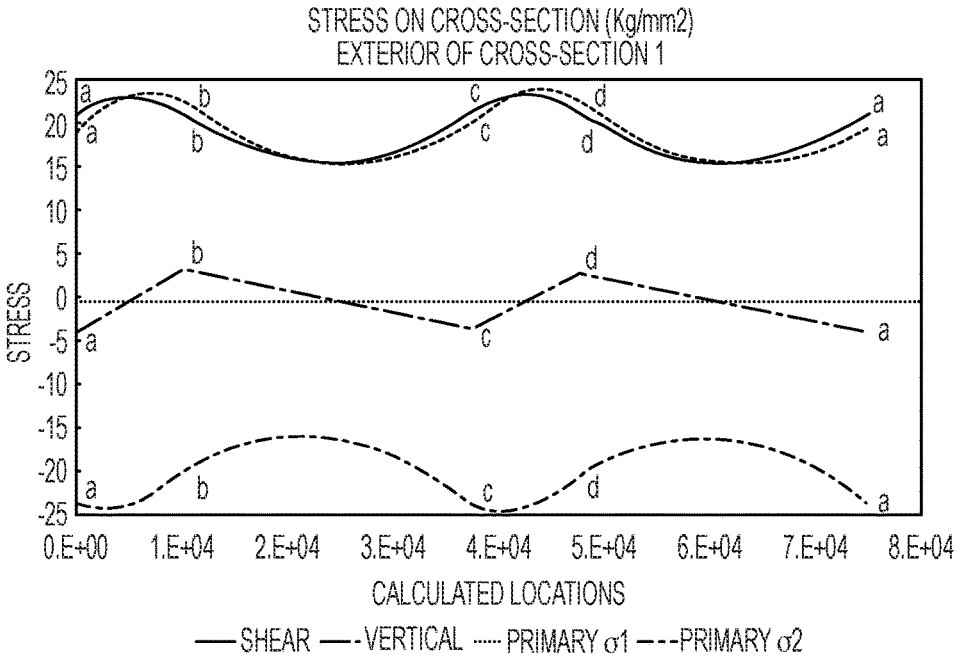
FIG. 8 PRIOR ART
FIG. 8 illustrates the bending torsion in the example of FIG. 6A through FIG. 6C.
Figure 11:
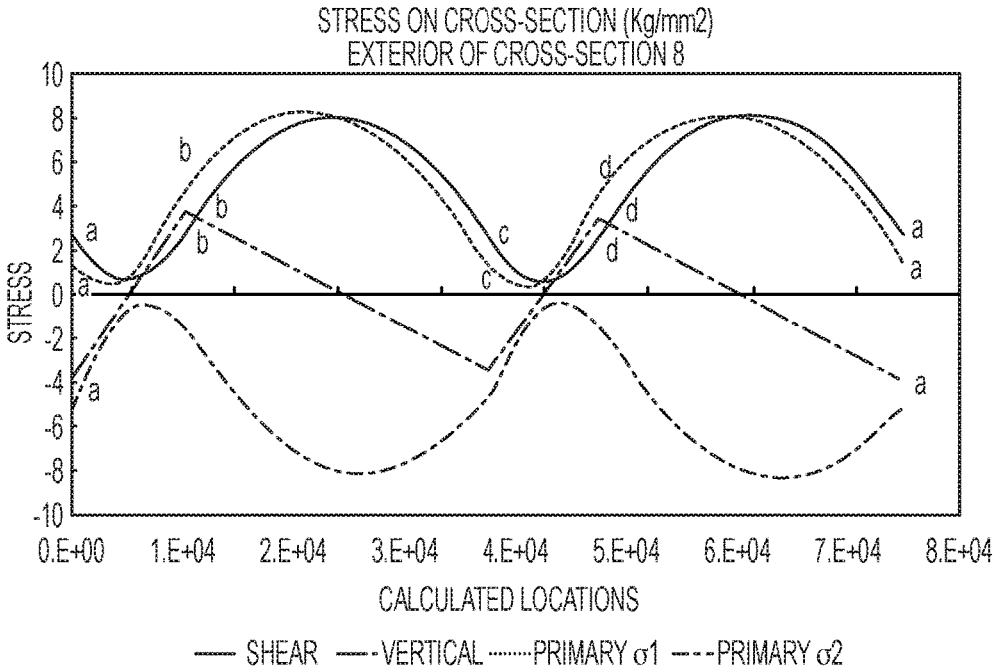
FIG. 11 PRIOR ART
FIG. 11 illustrates the bending torsion in the example of FIG. 9A through FIG. 9C.
Figure 12A:
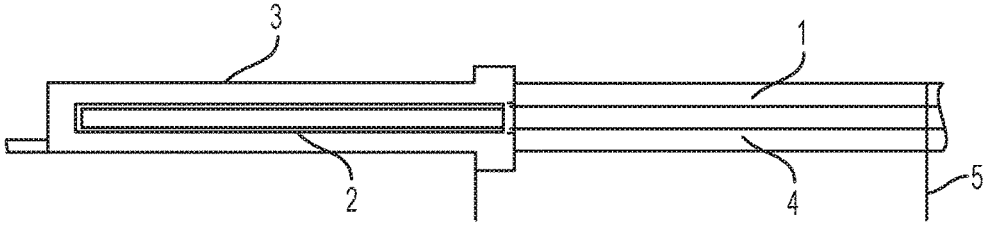
FIG. 12A and FIG. 12B illustrate a laterally sliding type opening/closing tidal gate.
Figure 12B:
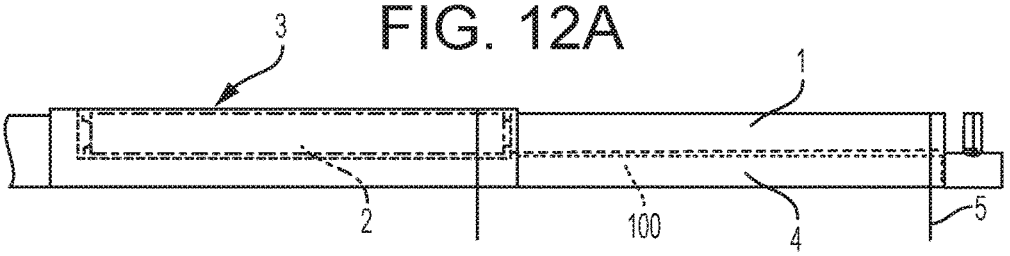

FIG. 12A and FIG. 12B show a laterally sliding type opening/closing tidal gate. These figures represent the left half of a sluice gate viewed from the seaside of the tidal gate. FIG. 12A is a plan view and FIG. 12B is an elevation view.

1 denotes a gate leaf in a completely closed state. 2 denotes a gate leaf in a completely opened state. The sluice gate of FIG. 12A and FIG. 12B is in either state 1 or 2.

3 denotes a storage dock, 4 denotes a rail foundation and 5 denotes a lateral center line of the tidal gate. 100 denotes an axle type support that works as a restriction point of the gate leaf 1 (may be referred to as "torsion structure 1" hereafter) and moves along the rail described later. A plurality of the axle type support 100 is provided at the gate leaf bottom. The plurality of the axle type support 100 is aligned according to the rail arrangement (for instance, in a linear fashion). Refer to FIG. 15A through FIG. 18B and description thereof for a detailed composition of the axle type support.

The gate leaf 2 in the completely opened state is stored in the storage dock 3. During use, the gate is moved laterally up to the position of the gate leaf 1 in the completely closed state.

The rail foundation 4 in FIG. 12A and FIG. 12B is a composite structure of concrete and steel, constructed in a shipbuilding dock etc., towed to its site and submerged in water. There is a possibility that the rail foundation 4 is deformed due to uneven settlement of the foundation ground under the rail foundation after the gate facility is completed. The rail deformation is either (1) uneven settlement of the rail keeping its straightness or (2) concave and convex deformation. Deformation (1) can be accommodated by re-alignment of the rail in the storage dock 3. While increase in load on a roller due to uneven contact of the rollers with the deformed rail surface as a result of the deformation (2) is expected, it is necessary to provide a means to avoid loss of the roller function (refer to Embodiment 3).

The torsion structure is defined for this embodiment.

FIG. 13A through FIG. 13C show the torsion structure where FIG. 13A is an elevation view, and FIG. 13B and FIG. 13C are views as seen from and along arrow A of FIG. 13A, FIG. 13B is the torsion structure before deformation, and FIG. 13C is the torsion structure after deformation.

L denotes the span of the torsion structure. 11 denotes a thin wall closed cross-section, and 12 denotes a sectional restriction point (the rotation axle of the axle type support 100). Solid lines at both ends of the support span and dotted lines sandwiched by the solid lines in the elevation view 13*a* correspond to the locations of the thin wall closed cross-section 11, and the sectional restriction point 12 indicates a restriction point for in-plane displacement of the nearest cross-section.

Dotted lines in FIG. 13B show the cross-sectional shapes at the location of the thin wall closed cross-section 11 of the torsion structure before deformation. Each cross-section is in an upright position since there is no deformation due to applied load.

Dotted lines in FIG. 13C show the cross-sectional shapes at the location of the thin wall closed cross-section 11 of the torsion structure after deformation. Each cross-section rotates around the sectional restriction point 12, and the thin wall closed cross-section 11 is in a twisting deformation state. Both ends of the torsion structure 1 have no deformation since they are in a fixed state.

FIG. 14A through FIG. 14C show details of the thin wall closed cross-section 11 and the sectional restriction point 12 of FIG. 13A through FIG. 13C. Parts that are the same or equivalent to those of FIG. 13A through FIG. 13C are given the same reference numerals and explanation thereof is omitted (the same holds true hereafter).

FIG. 14A is an elevation view and FIG. 14B and FIG. 14C are cross-sections of a view as seen from and along arrow A of FIG. 14A. FIG. 14B shows a state before deformation, and FIG. 14C shows a state after deformation.

13 denotes a cross-section of a member (it may be written as "thin wall" hereafter) composing the torsion structure 1.

The thin wall closed cross-section 11 is in an upright position as shown in FIG. 14B when there is no deformation due to applied load. The thin wall closed cross-section 11 is composed by the thin wall 13, which is continuous and closed.

The torsion structure 1 is deformed as shown in FIG. 14C due to an applied load. The thin wall closed cross-section 11 has rotated around the sectional restriction point 12.

The sectional restriction point 12 restricts the in-plane parallel displacement of the cross-section shown in the figure but does not restrict the rotation of the cross-section.

The torsion structure according to this Specification is characterized by the thin wall closed cross-section 11 composed by the thin wall 13 that is continuous and closed and the sectional restriction point 12 that restricts in-plane parallel displacement of the cross-section.

The axle type support 100 of Embodiment 1 is described according to FIG. 15A through FIG. 17. In FIG. 15A through FIG. 16, 14 denotes a rail, 15 denotes a rail head circular arc, 16 denotes a rail head center, 17 denotes a roller, 18 denotes a roller center line, 19 denotes a roller axle center, and 20 denotes a roller tread circular arc.

The head of the rail 14 supported by the rail foundation 4 is the circular arc 15 around the rail head center 16. The tread surface of the roller 17 is the circular arc 20 with a corresponding radius to radius of the rail head circular arc 15. The roller 17 is fixed to the gate leaf 1 (torsion structure 1) through the axle center 19 thereof.

Although nominal radii of the rail head circular arc 15 and the roller tread circular arc 20 are the same, a proper difference between the radii is necessary to realize a smooth fit between the rail 14 and the roller 17 while the roller 17 is moving laterally. The "corresponding radius" means a radius that has proper difference between the roller tread and the rail head.

FIG. 15A shows a state before deformation and FIG. 15B shows a state after deformation. FIG. 15B shows that the gate leaf 1 is twisted and deformed due to an applied load and rotated around rail head center 16. 21 denote a roller load and 22 denotes a contact surface between the roller 17 and the rail 14. Contact portions with the roller 17 and the rail 14 deform elastically and compose the contact surface 22.

A free twisting deformation of the gate leaf 1 (corresponding to previously mentioned "(1.1) Free twisting deformation" of Problem 1) is possible without any additional bending deformation since the roller 17 rotates around the rail head center 16 and linearity of the twisting center line of the structure is maintained.

The roller load 21 will surely be transmitted to the rail 14 through the contact surface 22 since the roller load is directed at the rail head center 16 (corresponding to previously mentioned "(1.2) Water pressure support while the gate is completely closed" of Problem 1).

Running of the roller 17 off the rail 14 while the gate leaf 1 is moving laterally with an applied load is described according to FIG. 16A through FIG. 17 (corresponding to previously mentioned "(1.3) Water pressure support while the gate is moving" of Problem 1).

In FIG. 16A through FIG. 16C, 23 denotes a tangent line to the contact surface 22. A denotes an angle between the roller center line 18 and the roller load 21.

FIG. 16A shows the case where θ is 0 degrees, FIG. 16B shows the case where θ is 45 degrees, and FIG. 16C shows the case where θ is 90 degrees.

A rotational plane of the roller 17 including the center of the contact surface 22 is parallel to the cross-section including the roller center line 18 and the rail head center 16.

Force to make the roller 17 run off the rail 14 is a friction force on the contact surface 22 created by a downward component of movement of a point on the rotation plane due to the rotation of the roller 17. This friction force is given by Formula (1). On the other hand, an off-running prevention force or a force to prevent the roller from running off the rail is a component parallel to the roller center line 18 of the roller load 21 and given by Formula (2).

$$\text{Friction force}=\text{roller load}\times\cos(90-\theta)\times\text{friction coefficient of contact surface} \quad (1)$$

$$\text{Off-running prevention force}=\text{roller load}\times\sin(90-\theta) \quad (2)$$

FIG. 17 is a result of a preliminary calculation by Formulas (1) and (2) in the cases of FIG. 16A through FIG. 16C where the roller load is 1000 tf and the frictional coefficient of the contact surface is 1.

According to this result, it is clear that the roller 17 will not run off the rail 14 if θ is less than 45 degrees.

It is possible that friction coefficient of the contact surface 22 in water will be 10% or less of the preliminary calculation since water can be expected to be a good lubricant. It is also possible that direction of the roller load 24 is much closer to the roller center line 18 than the case of θ=45 degrees. Accordingly, it is quite possible that the gate moves laterally without rollers running off the rail while water pressure corresponding to the gate operation condition is applied (corresponding to previously mentioned "(1.3) Water pressure support while the gate is moving" of Problem 1).

Embodiment 2

Embodiment 2 is explained while referencing FIG. 18A and FIG. 18B. 25 denotes load during gate movement. In this embodiment, a plurality of the roller 17 (two) is provided. They are arranged so as to sandwich the head region 15 of the rail 14. They face in different directions from each other. The axle centers 19 of the respective rollers 17 are fixed on the gate leaf 1.

FIG. 18B shows a relationship between load during gate movement 25 and roller load 21 that are in equilibrium.

In FIG. 18A and FIG. 18B, the roller loads 21 of the respective rollers 17 are directed at the rail head region 16, and the tangent line 23 of a contact surface intersects the roller center line 18 at a right angle. Accordingly, the gate moves laterally without the roller 17 running off the rail 14 (corresponding to previously mentioned "(1.3) Water pressure support during gate movement" of Problem 1).

Embodiment 3

Figure 19A:
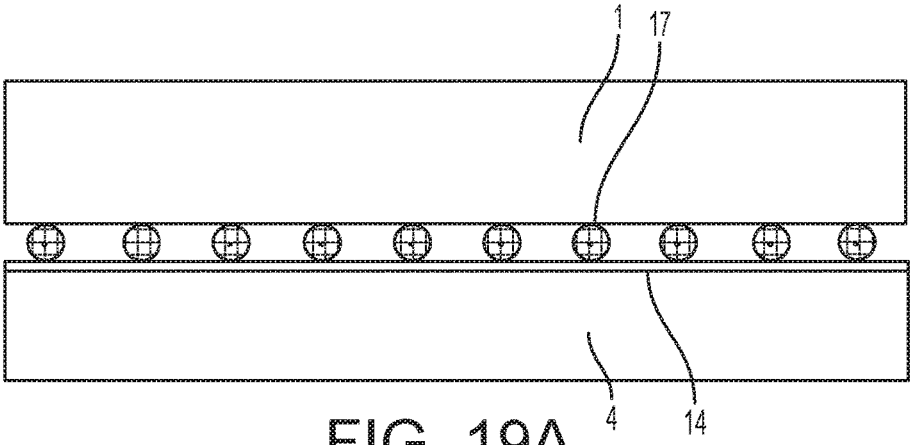
FIG. 19A through FIG. 19C are explanatory drawings of uneven settlement of a rail foundation and result of a divided torsion structure of Embodiment 3.

Embodiment 3 is explained while referencing FIG. 19A through FIG. 20C. FIG. 19A shows a condition where the rail foundation 4 has no uneven settlement and FIG. 19B shows a condition where the rail foundation 4 has a concave deformation due to its uneven settlement. FIG. 19C shows how the gate leaf 1 that is divided into two blocks work on the uneven settlement.

A plurality of the roller 17 normally stays on the rail 14 but some of them lift up off from the rail due to the uneven settlement. They are shown by blank rollers in the figure.

In the case of FIG. 19A where there is no uneven settlement, all of the rollers 17 stay on the rail 14 and share nearly equal loads in general.

Figure 19B:
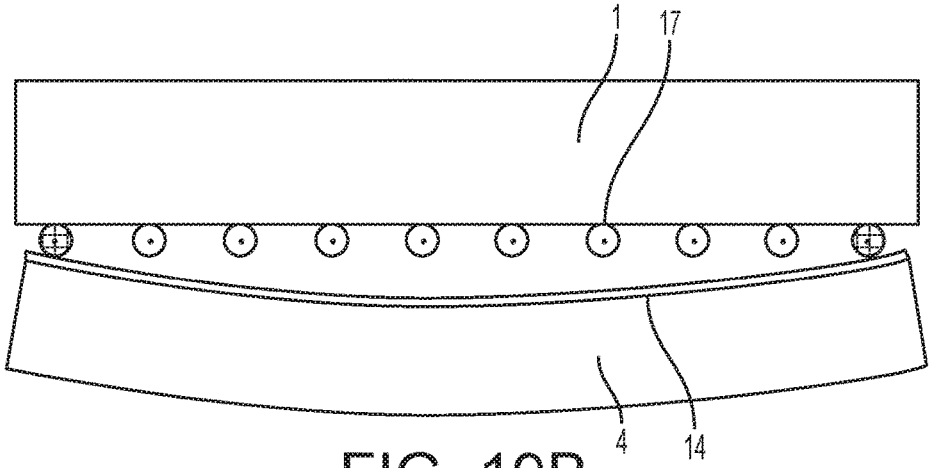
Figure 19C:
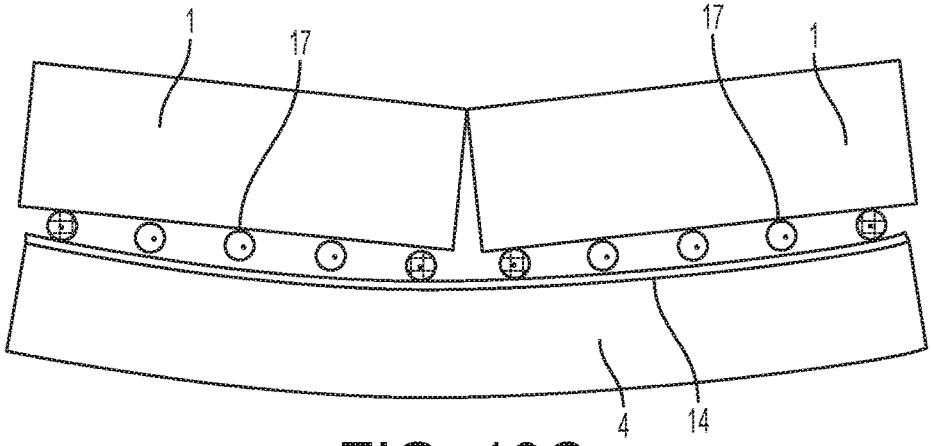

In the case of FIG. 19B where there is a concave deformation due to uneven settlement, only two of the rollers 17 located at both ends of the gate leaf 1 stay on the rail 14 and their load becomes more than in the case of FIG. 19*a*. The load in this case increases to approximately five times.

Therefore, let the gate leaf 1 be divided lengthwise into so many number of leaf blocks such that following capacity to the uneven settlement of the roller is improved. In the case of a bi-block gate leaf as shown on FIG. 19C, two of the roller 17 located at both ends of each block stay on the rail 14 and their load becomes less than in the case of FIG. 19B where there is a concave deformation due to uneven settlement (The load in this case increases to about 2.5 times, which is half of that in FIG. 19B.)

A suitable division number should be selected according to anticipated amount of uneven settlement, number of rollers, roller strength etc., which are conditions concerning safety of a roller. This can prevent a roller from losing its function due to uneven settlement. The smallest division number is desired since gate leaf division is a cause of structural cost increase.

Figure 20A:
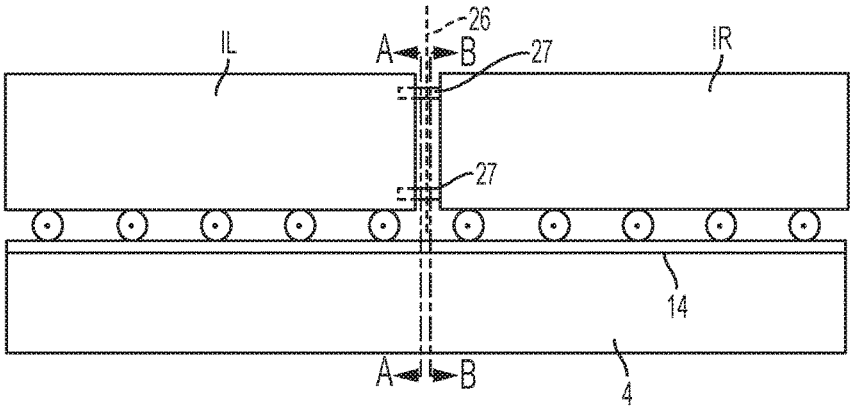
FIG. 20A through FIG. 20C are explanatory drawings of a joint of Embodiment 3.
Figure 20B:
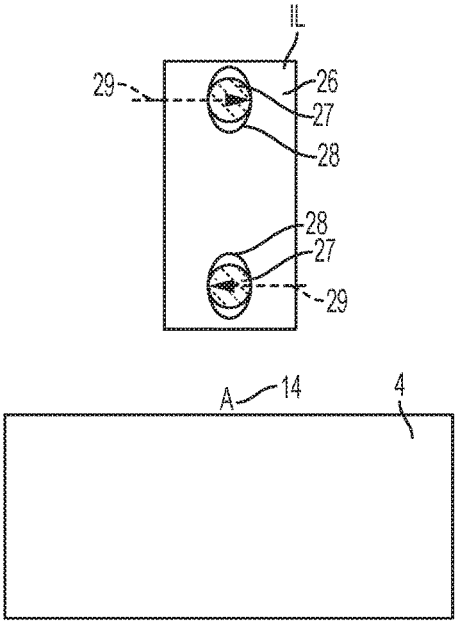
Figure 20C:
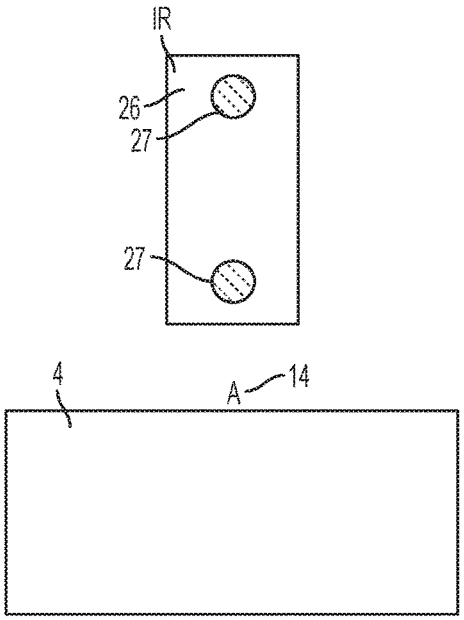

FIG. 20A through FIG. 20C are explanatory drawings for a coupling that joins divided blocks of the gate leaf 1 and transmits torsion moment from a block to the next block. FIG. 20A is an elevation view, FIG. 20B is a cross-section as viewed from and along arrow A of FIG. 20A and FIG. 20C is a cross-section as viewed from and along arrow B of FIG. 20A.

26 denotes a divided face, 27 denotes a torsion moment transmission bar, 28 denotes a torsion moment receiving hole, and 29 denotes a coupling force.

The torsion moment transmission bar 27 is fixed to a gate leaf 1R on the right side of the divided face 26. The tip thereof fits a gate leaf 1L on the left side of the divided face 26. Torsion moment of the gate leaf 1R on the right side of the divided face 26 is transmitted to the gate leaf 1L on the left side of the divided face 26 through the torsion moment transmission bar 27.

The tip of the torsion moment transmission bar 27 and the torsion moment receiving hole 28 have fit each other well. The torsion moment is transmitted in the form of a coupling force 29 from the tip of the torsion moment transmission bar to a sidewall of the torsion moment receiving hole 28. The torsion moment transmission bar 27 and the torsion moment receiving hole 28 move differently in order to follow uneven settlement of the rail foundation 14. In light thereof, the torsion moment receiving hole 28 is made to be a vertically long hole. It should be long enough so that the tip of the torsion moment transmission bar 27 and the torsion moment receiving hole 28 fit together well.

While there may be many alternatives for the mechanism of the coupling for transmission of the torsion moment of the divided face 26, the transmission is generally carried out in the form of a coupling force.

An additional device to make opposing divided faces 26 watertight is required.

Distance between the opposing divided faces 26 needs to be maintained while the divided blocks are moving, completely closed, and stored. The maintaining method depends upon pulling type, push type, self-propelling type etc., which are well-known lateral movement methods. Number of division is arbitrary but fewer is cost effective.

Embodiment 4

Figure 21:
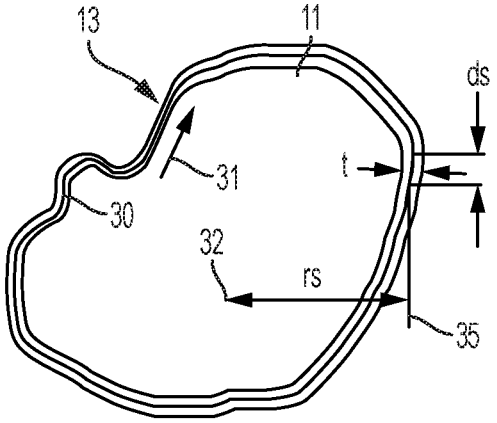
FIG. 21 is an explanatory drawing of the s coordinate used to show a result of a warping alleviation method.
Figure 22:
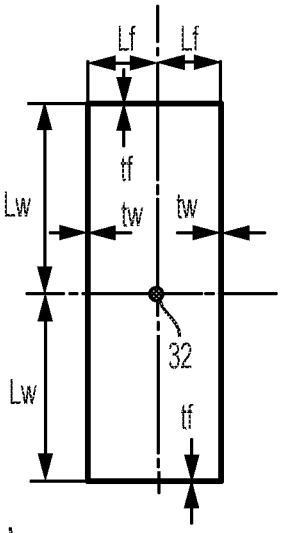
FIG. 22 is an explanatory drawing of a rectangular thin wall closed cross-section of Embodiment 4.

A warping alleviation method for the torsion structure is explained while referencing FIG. 21 and FIG. 22.

FIG. 21 shows an s coordinate that is necessary for explaining a result of the warping alleviation method. Parts that are the same or equivalent to those already shown are given the same reference numerals and explanation thereof is omitted.

30 denotes an s coordinate set along a center line of the thin wall closed cross-section 11, 31 denotes a positive direction of the s coordinate 30, and 32 denotes a shearing center of the thin wall closed cross-section 11.

ds denotes a small distance on the s coordinate 30. t denotes thickness of the thin wall at ds, 35 denotes a tangent line of ds, and rs denotes the length of a normal from the shearing center 32 to the tangent line 35.

Warping of the thin wall closed cross-section 11 is expressed by function Ψ of Formula (3). As included in Formula (3) denotes area of the thin wall closed cross-section 11. Ψ0 (warping constant) is the value of Ψ at its contour integration starting point and is expressed by Formula (4). Integration of Formula (3) and Formula (4) is executed on the s coordinate 30.

[Formula 1]

$$\Psi = \Psi_0 - \int_0^s r_s\,ds + 2A_0 \int_0^1 \frac{1}{t} s \div \oint \frac{ds}{t} \tag{3}$$

$$\Psi_0 = \left( \oint t \int_0^x r_x\,dsds - 2A_0 \div \oint \frac{ds}{t} \oint t \int_0^s \frac{1}{t} dsds \right) \div \oint t ds \tag{4}$$

t denotes "thickness at an arbitrary point on the thin wall closed cross-section." rs denotes "the length of a normal from the shearing center of thin wall closed cross-section to the tangent line at the point."

The value of (wall thickness at arbitrary point on the thin wall closed cross-section)×(length of a normal from the shearing center of thin wall closed cross-section to the tangent line at the point) is a constant.

$$t \times rs = \text{constant on each cross-section} = C \tag{5}$$

Both Ψ and Ψ0 are zero when Formula (5) is substituted for Formula (3) and Formula (4) and integration of these formulas is executed. As a warp of the cross-section is zero as long as the warping function Ψ and the warping constant Ψ0 are zero, vertical stress proportional to the warp is also zero, and bending-torsion shearing stress in equilibrium with the vertical stress is also zero. In short, alleviation of bending torsion is realized (Problem 3).

A result of the warping alleviation method proposed in this embodiment is explained using a specific cross-sectional shape.

(1) Rectangular Form

The left side of FIG. 22 shows a rectangular thin wall closed cross-section, and the right side of the figure shows its scantlings. Parts that are the same or equivalent to those already shown are given the same reference numerals and explanation thereof is omitted.

Lf denotes half of flange width, Lw denotes half of web height. tf denotes thickness of the flange, and tw denotes thickness of the web.

Formula (5) on the zero-warp condition becomes Formula (6) since the shearing center 32 coincides with the center of the figure.

$$tf = tw \times Lw \div Lf \tag{6}$$

tf is approximately 12.4 mm when calculated by Formula (6) based on Lf, Lw and tw shown on the right side of FIG. 22.

Figure 23:
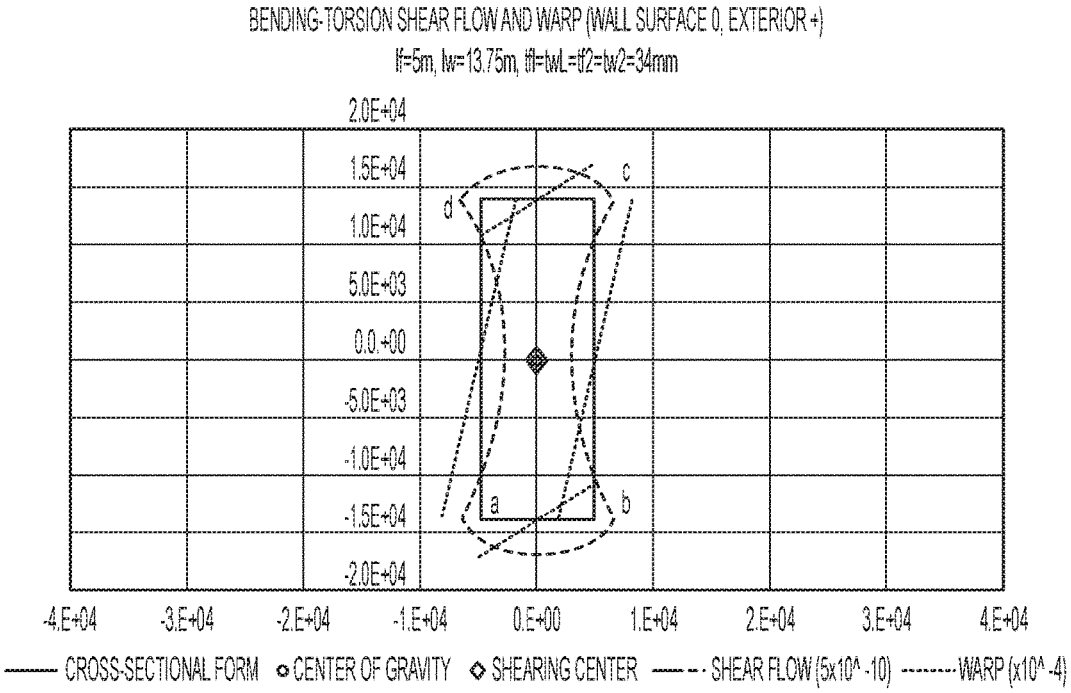
FIG. 23 is an explanatory drawing of calculation results of warping function L and bending-torsion shear flow of Embodiment 4.
Figure 24:
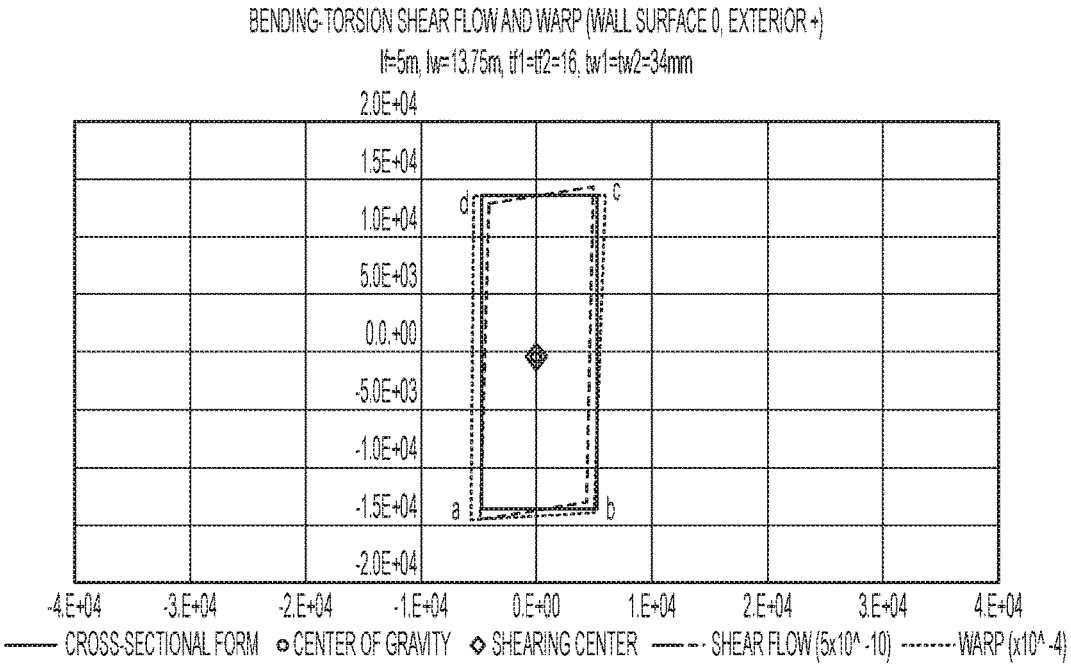
FIG. 24 is an explanatory drawing of calculation results of warping function L and bending-torsion shear flow of Embodiment 4.
Figure 25:
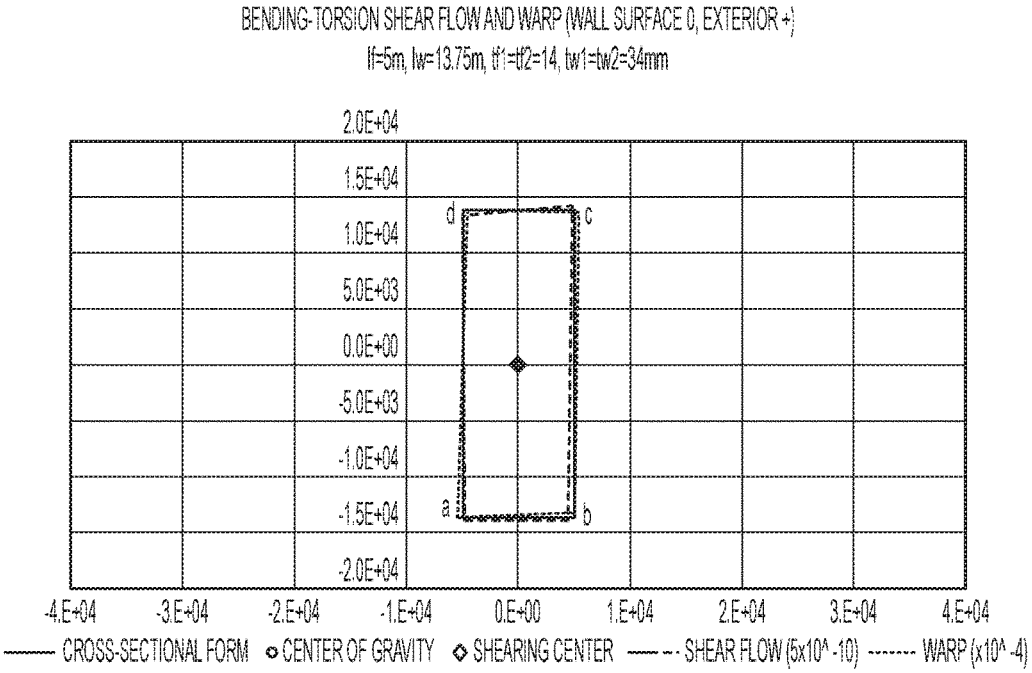
FIG. 25 is an explanatory drawing of calculation results of warping function L and bending-torsion shear flow of Embodiment 4.
Figure 26:
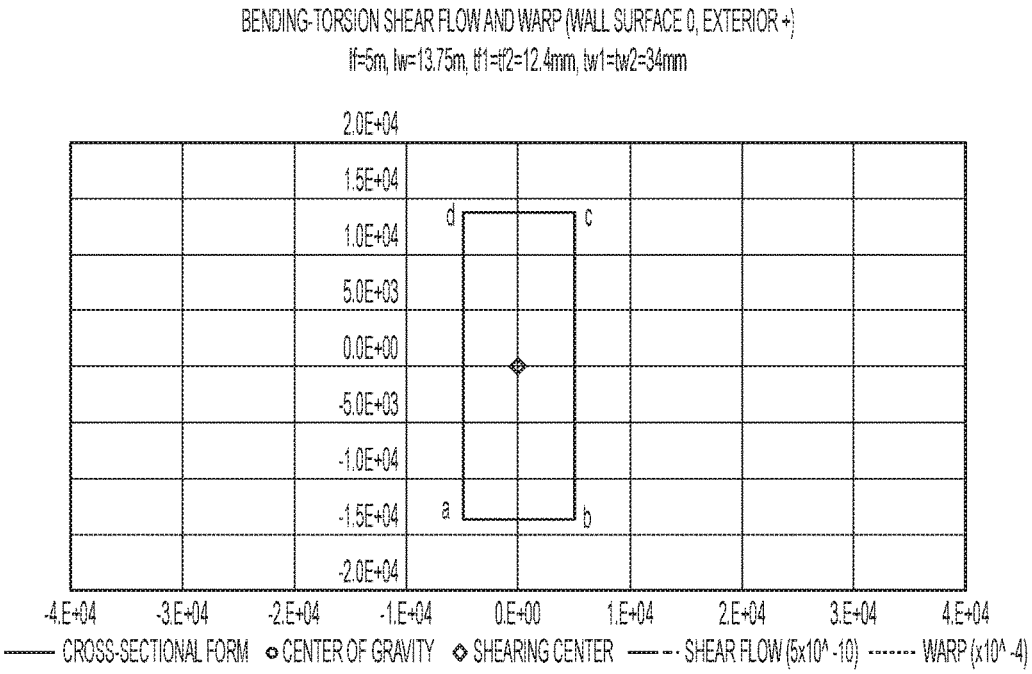
FIG. 26 is an explanatory drawing of calculation results of warping function L and bending-torsion shear flow of Embodiment 4.

FIG. 23 through FIG. 26 show the calculation results from the warping function Ψ and bending-torsion shear flow when tf is changed between 34 mm and 12.4 mm.

tf is 34 mm in FIG. 23, tf is 16 mm in FIG. 24, tf is 14 mm in FIG. 25, and tf is 12.4 mm in FIG. 26.

Bending-torsion shear flow as well as warping function Ψ approach zero as tf approaches 12.4 mm. Bending-torsion shear flow corresponds to shearing stress distribution due to bending-torsion moment.

Figure 27:
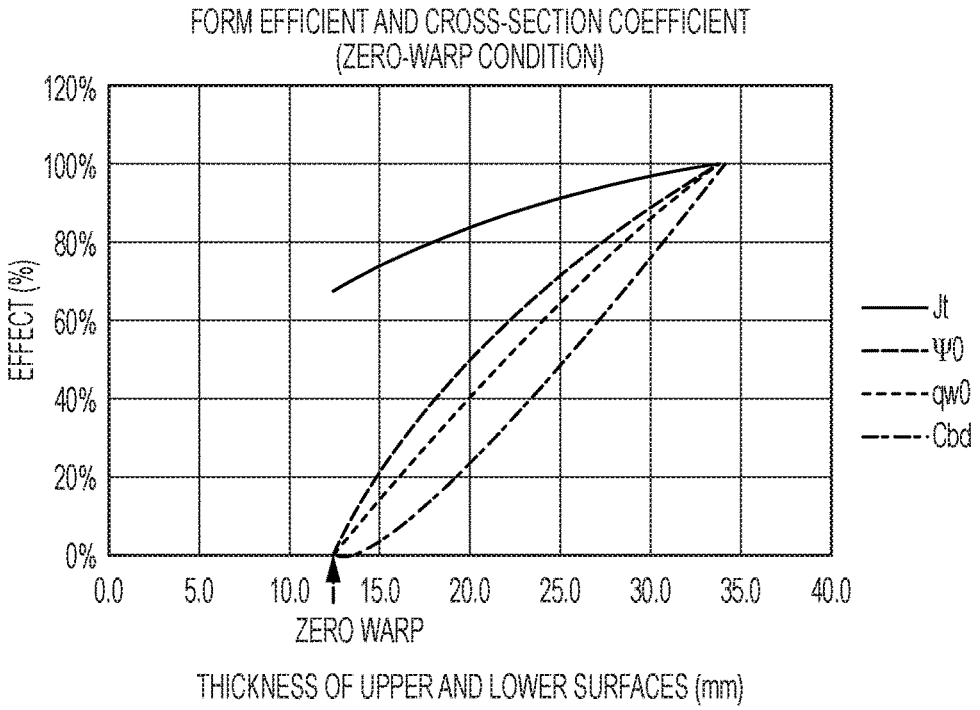
FIG. 27 is an explanatory drawing collecting the results of FIG. 23 through FIG. 26.

FIG. 27 shows in percentages, when the resulting value when tf is 34 is set as 100, the calculations results of warping constant Ψ0, bending-torsion shear flow constant qw0, bending-torsion cross-section coefficient Cbd, and torsion cross-section coefficient Jt calculated when tf has decreased from 34 mm to 12.4 mm by 1 mm at a time. The lateral axis of the figure gives tf.

Ψ0 and qw0 relating to magnitude of warping and bending-torsion shearing stress respectively decrease rapidly toward a zero-warp point. Cbd and Jt also decrease. Impact of decrease in Jt is very important. As Jt takes a main role in deformation control of the torsion structure, its decrease leads to increase in deformation, and cancellation of the warping (form coefficient) reduction effect due to the relationship: bending-torsion stress=form coefficient×deformation×spring constant may be made. Jt may be compensated by change in the closed cross-sectional form.

For instance, cut in gate weight is possible by increasing Lf. While theoretical gate weight becomes minimal when zero-warp condition is achieved, an object of warping reduction in optimum design is cost reduction. As cost component factors include material, fabrication, transportation, site construction, maintenance, operation etc., the minimum gate weight does not necessarily mean the minimum cost. For instance, there is an option that a high tensile steel plate having a custom-ordered thickness is fit in the stress increased zone so as to keep the minimum gate weight. However, it may be a better idea in terms of cost to increase the gate weight so as to maintain the material strength since the cost of material and fabrication rises.

So far, stress generated by overall structural deformation due to simple torsion, bending torsion, warping, bending etc. is considered a sectional stress. But partial stresses, such as bending of gate plates and their stiffeners due to applied water pressure, partial bending due to reaction forces applied to supports and support ends etc., must also be considered. Accordingly, a torsion structure designed according to zero-warp condition is not assured a minimum weight. Since an actual conventional means for finding an optimum design in cost is to select the best one among multiple plans, a planar range of optimum design selections composed by a line approaching the zero-warp point and a sectional form change line so as to compensate Jt is targeted. This idea is the background of a proposal, according to the present invention, that the value of (thickness at an arbitrary point on the thin wall closed cross-section)×(length of a normal from the shearing center of thin wall closed cross-section to the tangent line at the point) must be kept near a constant point within the range required by the optimum design. The optimum design denotes an advantageous design mainly in cost, nearly satisfying the zero-warp condition.

(2) Lens Type Cross-Section

Figure 28:
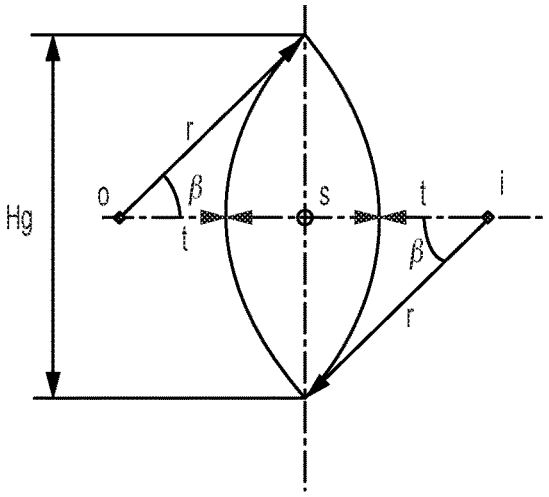
FIG. 28 is an explanatory drawing of a lens type thin wall closed cross-section in Embodiment 4.

FIG. 28 shows a lens type thin wall closed cross-section. Hg denotes lens gate height, r denotes thin wall radius, β denotes thin wall angle, t denotes thin wall thickness, s denotes shearing center, and i and o both denote the center of the thin wall radius r.

As the shearing center s coincides with the center of the figure, Formula (5) of the zero-warp condition can be converted to Formula (7).

$$\eta(\alpha)=(r-L(s,\ i))\div(r-L(s,\ i)\times\cos(\alpha)) \quad (7)$$

where $\eta(\alpha)$ denotes a ratio of thickness for the zero-warp condition to the thin wall thickness. $\alpha$ denotes an angle between the thin wall radius r and a line segment oi, and $0\leq\alpha\leq\beta$. L (s, i) denotes a line segment si.

Figure 29:
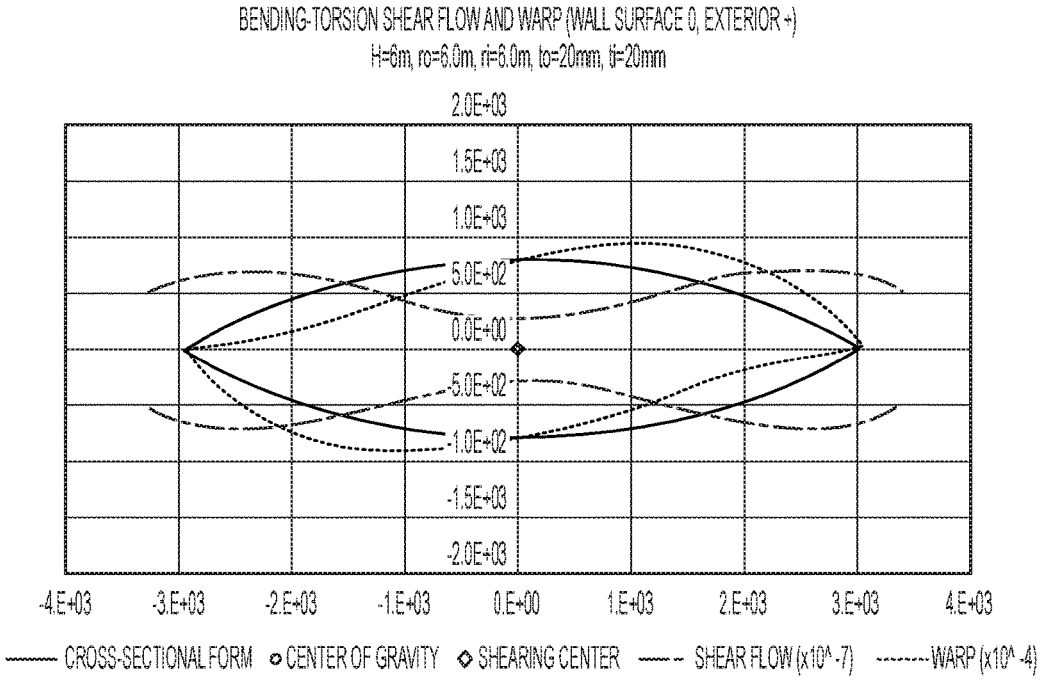
FIG. 29 is an explanatory drawing of warping function L and bending-torsion shear flow of the lens type thin wall cross-section of FIG. 28.

FIG. 29 shows the warping function and the bending-torsion shear flow of the lens type thin wall cross-section of FIG. 28. Distribution of warping magnitude and vertical stress is proportional to the warping function, and distribution of bending-torsion shearing stress is proportional to the graph of the bending-torsion shear flow.

Figure 30:
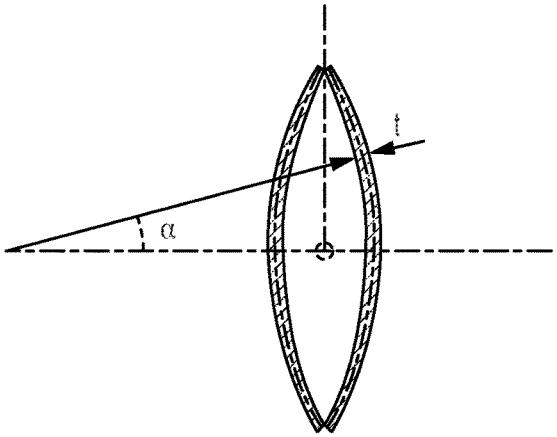
FIG. 30 is an explanatory drawing of thickness of the lens type thin wall cross-section of FIG. 28.

The right side of FIG. 30 shows thickness calculated by Formula (7) at 11 $\alpha$ points on the lens type thin wall cross-section. Bending torsion on the lens type thin wall cross-section having the thickness as in FIG. 30 is eliminated and the shear flow and the warping of FIG. 29 disappear (Problem 3).

EXPLANATION OF REFERENCE NUMERALS

1: gate leaf (torsion structure)
1R: divided right side gate leaf block (first part)
1L: divided left side gate leaf block (second part)
14: rail
15: rail head region (convex circular arc)
17: roller
20: roller sliding part (concave circular arc)
27: torsion moment transmission bar (coupling)
28: torsion moment receiving hole (coupling)
100: axle type support

The invention claimed is:

1. A sluice gate that is provided passing over a sluice for water flow or ships, said sluice gate comprising:

a torsion structure that comprises a closed cross-section formed by a thin wall provided in a direction crossing over the sluice;

a rail provided in the direction crossing over the sluice; and a plurality of axle supports provided along a bottom of the torsion structure, that work as restriction points and move along the rail; wherein a cross-sectional form of a head region of the rail is a convex circular arc of 180 degrees or greater, each axle support comprises a roller that moves along the rail in the direction crossing over the sluice by rotating along the head region of the rail, a cross-sectional form of a tread surface of each roller is a concave circular arc whose radius corresponds to the radius of the convex circular arc of the head region of the rail, the closed cross-section rotates about the head region of the rail relative to closed cross-sections at an adjacent respective restriction point as a result of the plurality of closed cross-sections being in a twisting deformation state, and a torsion moment composed of an applied load and a reaction force at the restriction point is transmitted to a terminal of the structure due to a torsion rigidity.

2. The sluice gate of claim 1, wherein the product of a thickness t at an arbitrary point on the closed cross-section of the torsion structure and a length rs of a normal from the shearing center of the closed cross-section to the tangent line at the point is set as a constant or so as to stay within a predetermined range.

3. The sluice gate of claim 1, wherein the closed cross-section of the torsion structure is rectangular, and tf is set larger than tw×Lw÷Lf and smaller than tw, where Lf denotes half of a flange width of the rectangular closed cross-section, Lw denotes half of a web height, tf denotes flange thickness, and tw denotes web thickness.

4. The sluice gate of claim 1, wherein the closed cross-section of the torsion structure is a convex lens form, and the closed cross-section with the convex lens form is thinner towards an end in compliance with a ratio $\eta(\alpha)$ of thickness, wherein the ratio $\eta(\alpha)$ of thickness is found by the formula:

$$\eta(\alpha)=(r-L(s,\ i))\div(r-L(s.\ i)\times\cos(\alpha)),$$

where r denotes respective radii of thin walls of both sides of the cross-section with the convex lens form, i and o respectively denote centers of the radii, L (s, i) denotes a line segment connecting the i and the o, and $\alpha$ denotes an angle between an arbitrary point on the thin wall of the cross-section with the convex lens form and the line segment si or line segment connecting i and o.

5. The sluice gate of claim 1, wherein the torsion structure is divided into a first portion blocking a part of the sluice and a second portion blocking at least a part of another portion of the sluice, and the first portion and the second portion are joined by a coupling that transmits a torsion moment.

6. A sluice gate that is provided passing over a sluice for water flow or ships, said sluice gate comprising:

a torsion structure that comprises a closed cross-section formed by a thin wall provided in a direction crossing over the sluice;

a rail provided in the direction crossing over the sluice; and a plurality of axle supports provided along a bottom of the torsion structure, that work as restriction points and move along the rail; wherein a cross-sectional form of a head region of the rail is a convex circular arc of 180 degrees or greater, each axle support comprises multiple rollers that move along the rail in the direction crossing over the sluice by rotating along the head region of the rail, the multiple rollers of each axle support are arranged so as to sandwich the head region of the rail, the closed cross-section rotates about the head region of the rail relative to closed cross-sections at an adjacent respective restriction point as a result of the closed cross-section being in a twisting deformation state, and a torsion moment composed of an applied load and a reaction force at the restriction point is transmitted to a terminal of the structure due to a torsion rigidity.

7. The sluice gate of claim 6, wherein the product of a thickness t at an arbitrary point on the closed cross-section of the torsion structure and a length rs of a normal from the shearing center of the closed cross-section to the tangent line at the point is set as a constant or so as to stay within a predetermined range.

8. The sluice gate of claim 6, wherein the closed cross-section of the torsion structure is rectangular, and tf is set larger than tw×Lw÷Lf and smaller than tw, where Lf denotes half of a flange width of the rectangular closed cross-section, Lw denotes half of a web height, tf denotes flange thickness, and tw denotes web thickness.

9. The sluice gate of claim 6, wherein the closed cross-section of the torsion structure is a convex lens form, and the closed cross-section with the convex lens form is thinner towards an end in compliance with a ratio $\eta(\alpha)$ of thickness, wherein the ratio $\eta(\alpha)$ of thickness is found by the formula:

$$\eta(\alpha)=(r-L(s,\ i))\div(r-L(s.\ i)\times\cos(\alpha)),$$

where r denotes respective radii of thin walls of both sides of the cross-section with the convex lens form, i and o respectively denote centers of the radii, L (s, i) denotes a line segment connecting the i and the o, and $\alpha$ denotes an angle between an arbitrary point on the thin wall of the cross-section with the convex lens form and the line segment si or line segment connecting i and o.

10. The sluice gate of claim 6, wherein the torsion structure is divided into a first portion blocking a part of the sluice and a second portion blocking at least a part of another portion of the sluice, and the first portion and the second portion are joined by a coupling that transmits a torsion moment.

* * * * *